US009499309B2

(12) United States Patent
Zerfas et al.

(10) Patent No.: US 9,499,309 B2
(45) Date of Patent: Nov. 22, 2016

(54) RECLOSABLE PACKAGING USING A LOW-TACK ADHESIVE FASTENER

(75) Inventors: Paul Anthony Zerfas, Verona, WI (US); Terence Edward Isham, Brackley (GB); Paul Edward Doll, Madison, WI (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 555 days.

(21) Appl. No.: 13/192,861

(22) Filed: Jul. 28, 2011

(65) Prior Publication Data

US 2013/0026170 A1 Jan. 31, 2013

(51) Int. Cl.

| | |
|---|---|
| ***B65D 33/20*** | (2006.01) |
| ***B65D 75/44*** | (2006.01) |
| ***B65B 9/08*** | (2012.01) |
| ***B65B 61/18*** | (2006.01) |

(Continued)

(52) U.S. Cl.

CPC ..... *B65D 33/20* (2013.01); *B65B 9/08* (2013.01); *B65B 9/213* (2013.01); *B65B 61/182* (2013.01); *B65D 75/44* (2013.01); *B65D 75/5805* (2013.01); *B65D 75/5855* (2013.01); *B31B 2219/6007* (2013.01); *B31B 2219/9006* (2013.01); *B31B 2219/9012* (2013.01); *B31B 2237/10* (2013.01); *B31B 2237/406* (2013.01)

(58) Field of Classification Search

CPC .. B65D 33/20; B65D 2312/02; B65D 33/24; B65D 33/1691; B65D 75/44; B65D 75/5805; B65D 74/5855; C08L 23/0853; B65B 9/08; B65B 61/182; B31B 2219/6007; B31B 2219/9006; B31B 2219/9012; B31B 2237/10; B31B 2237/406

USPC ..... 383/210, 210.1, 211, 88; 220/315

See application file for complete search history.

(56) References Cited

U.S. PATENT DOCUMENTS 2,066,495 A * 1/1937 Swift ..... 229/80
3,203,551 A * 8/1965 Loan, Jr. ..... 210/486

(Continued)

FOREIGN PATENT DOCUMENTS

FR 2150897 A1 4/1973
FR 2819488 7/2002

(Continued)

OTHER PUBLICATIONS

European Search Report for Application No. EP 12 27 5111, dated for Oct. 20, 2012, 7 pages, entire document.

*Primary Examiner* — Peter Helvey

(74) *Attorney, Agent, or Firm* — Fitch, Even, Tabin & Flannery LLP

(57) ABSTRACT

A flexible film package having an adhesive based reclosable fastener having a flexible film substrate forming a plurality of package walls sealed to form an interior cavity for receiving a product; the plurality of walls having at least two opposing flexible walls; a package mouth, initially sealed, to permit access to the interior cavity; a low tack pressure sensitive adhesive (LTPSA) layer disposed on each of an exterior surface of the parallel walls, the LTPSA sized and oriented in positions to oppose one another at a plurality of positions when the package is reclosed to allow progressively decreased size of the interior cavity as product is removed; and wherein a bond strength of the LTPSA to the flexible film substrate is greater than an adhesion between LTPSA areas. The mouth can be formed by a peelable seal or by a defined area of weakness.

15 Claims, 15 Drawing Sheets

(51) Int. Cl.

| | |
|---|---|
| ***B65B 9/213*** | (2012.01) |
| ***B65D 75/58*** | (2006.01) |

(56) References Cited

U.S. PATENT DOCUMENTS

| | | | | |
|---|---|---|---|---|
| 3,446,420 | A * | 5/1969 | Rinecker | 383/89 |
| 3,504,475 | A * | 4/1970 | Hamilton et al. | 53/410 |
| 4,567,987 | A | 2/1986 | Lepisto et al. | |
| 4,584,201 | A | 4/1986 | Boston | |
| 4,686,814 | A * | 8/1987 | Yanase | 53/459 |
| 4,706,297 | A * | 11/1987 | Ausnit | 383/63 |
| 5,044,776 | A | 9/1991 | Schramer et al. | |
| 5,286,112 | A * | 2/1994 | Bible | 383/86 |
| 5,772,331 | A * | 6/1998 | Irace et al. | 383/90 |
| 5,941,640 | A * | 8/1999 | Thatcher | 383/22 |
| 6,146,016 | A * | 11/2000 | Mucci et al. | 383/7 |
| 6,332,712 | B1 * | 12/2001 | Headley | 383/64 |
| 6,517,243 | B2 * | 2/2003 | Huffer et al. | 383/88 |
| 6,805,486 | B2 * | 10/2004 | Smith et al. | 383/92 |
| 7,708,463 | B2 * | 5/2010 | Sampaio Camacho | 383/62 |
| 8,500,707 | B2 * | 8/2013 | Murray | 604/332 |
| 2003/0019780 | A1 * | 1/2003 | Parodi et al. | 206/524.1 |
| 2004/0008908 | A1 * | 1/2004 | Shepard | 383/89 |
| 2004/0234175 | A1 * | 11/2004 | Takita et al. | 383/905 |
| 2006/0228056 | A1 * | 10/2006 | Ausnit | 383/64 |
| 2006/0251341 | A1 | 11/2006 | Sampaio Camacho | |
| 2007/0104395 | A1 * | 5/2007 | Kinigakis et al. | 383/61.1 |
| 2008/0013869 | A1 | 1/2008 | Forman | |
| 2008/0056622 | A1 * | 3/2008 | Austreng et al. | 383/5 |
| 2008/0115458 | A1 * | 5/2008 | Funaki et al. | 53/373.7 |
| 2009/0279813 | A1 * | 11/2009 | Pokusa et al. | 383/211 |
| 2011/0143133 | A1 * | 6/2011 | Kinigakis et al. | 428/345 |
| 2011/0211773 | A1 * | 9/2011 | Romeo et al. | 383/2 |

FOREIGN PATENT DOCUMENTS

| | | |
|---|---|---|
| GB | 560708 | 4/1944 |
| GB | 2070564 | 9/1981 |
| GB | 491682 | 9/1983 |
| WO | 0226579 A1 | 4/2002 |

* cited by examiner

RECLOSABLE PACKAGING USING A LOW-TACK ADHESIVE FASTENER

FIELD

This disclosure relates generally to reclosable fasteners for flexible packages and, in particular, to low tack adhesive reclosable fastener systems for flexible packages.

BACKGROUND

Packaging, especially flexible packaging, is useful to retain food and other consumer products for shipping and storage. Flexible film packaging can have many advantages. It can be manufactured at substantially lower cost than rigid containers, is light-weight resulting in reduced transportation costs, and can pack easily resulting in reduced storage space compared to other types of rigid packaging.

Despite these advantages, product freshness and containment within the package can be an issue when more product is provided than desired by a consumer for a single use. Several types of closures and fasteners are available for reclosing a previously opened flexible package. It is common to use mechanical reclosable fasteners, such as slide zippers, clips, tabs, interlocking strips, and the like. For example, some types of flexible packaging, such as vertically formed filled and sealed (VFFS) bagged product packaging, can provide various re-sealable zipper applications, such as plastic zippers sold under the trade name of ZIP-PAK (by Illinois Tool Works, Inc.). Nevertheless, use of this and other types of fasteners often requires complex manufacturing steps to apply, interconnect, and align the mechanical fastening feature of each structure. Further, packaging with zipper applications typically does not allow the package to reduce the headspace above the product as it is removed.

Adhesive-based reclosable fasteners, such as a pressure sensitive adhesive (PSA) can be an alternative to the mechanical fastener. In one attempt, a high-tack adhesive layer can be applied to a package web/film surface. The adhesive layer can be covered by a releasable liner that can be removed by a user when needed to close the package by rolling the film against the adhesive layer (See generally, U.S. Pat. No. 5,044,776 to Schramer et al.).

Adhesive-based fasteners can present challenges in both manufacturing and in consumer use. The adhesive can delaminate from the film substrate to which it is affixed rather than peel at its cohesive interface. Further, many PSAs have high tack levels. Tack is a property of an adhesive material that generally enables the material to form a bond with the surface of another material upon brief and/or light pressure. A high tack adhesive printed on the surface of a flexible film can cause problems during manufacturing in that the film used for packaging will not unwind freely from the roll stock. This is known as "blocking". In use, particulate products contained within the flexible package (such as cookie crumbs, coffee, shredded cheese, and the like) can stick to the high tack PSA, thus reducing its adhesive effectiveness. Further, a consumer may find it undesirable to also stick to the PSA. One attempt to resolve this problem is the use of a lower tack PSA, though this has often increased the likelihood of delamination from the package film, as described above.

SUMMARY

Accordingly, provided herein are embodiments that relate to packaging products, and in particular to reclosable packaging products using low-tack adhesive zones permanently affixed to the film of the package as a fastener that is self-adhering, but does not stick to unlike surfaces.

In some embodiments, the package can have an initial seal against ambient atmosphere (e.g., a gas and moisture barrier) for extended periods of time and have areas of low tack pressure sensitive adhesive (LTPSA) formed on at least one exterior surface (zone) of the package and optionally at least one interior surface (zone). The LTPSA zones are oriented so that they are adjacent to each other when the package is reclosed. The embodiments can be easily opened and reclosed/resealed, while maintaining package integrity.

One embodiment provides a flexible film package having an adhesive based reclosable fastener having a flexible film substrate forming a plurality of package walls sealed to form an interior cavity for receiving a product; the plurality of walls having at least two opposing flexible walls; a package mouth, initially sealed, to permit access to the interior cavity; a low tack pressure sensitive adhesive (LTPSA) layer disposed on each of an exterior surface of the parallel walls, the LTPSA sized and oriented in positions to oppose one another at a plurality of positions when the package is reclosed to allow progressively decreased size of the interior cavity as product is removed; and wherein a bond strength of the LTPSA to the flexible film substrate is greater than an adhesion between LTPSA areas. The mouth can be formed by a peelable seal or by a defined area of weakness.

In some embodiments, the LTPSA can be a UV-curable acrylic oligomer, a tack control component and the flexible film comprises an organoclay. Optionally, the LTPSA can have at least one elastomeric material. The LTPSA layer can be in the range of about 0.1 to about 5 mils in thickness, but preferably in the range of about 0.8 to about 5 mils in thickness. The peel force of the LTPSA layers is about 200 to 900 grams per inch.

The film for the present embodiments can be a laminate in the range of about 1 to 10 mils in total thickness, and wherein a laminate layer bound to the LTPSA can be a reverse-printed, oriented polyester film (OPET) in the range of about 0.3 to 1 mils thick. The film optionally has a filler selected from the list of calcium carbonate, dolomite, talc, mica, phyllosilicates, organically modified montmorillonite, and various combinations thereof.

An alternate embodiment can provide a flexible film package having an adhesive based reclosable fastener, having a flexible film substrate forming a plurality of package walls sealed to form an interior cavity for receiving a product; the plurality of walls having at least two opposing flexible walls; a package mouth, initially sealed, to permit access to the interior cavity; and a pair of low tack pressure sensitive adhesive (LTPSA) layers disposed on the same exterior panel surface generally aligned to each other and generally equi-distant to a fold line between the LTPSA layer. The package mouth can be formed by a defined area of weakness.

Another embodiment can provide a flexible film package having an adhesive based reclosable fastener, having a flexible film longitudinally sealed generally along adjacent sides to form a sleeve; a first sleeve end peelable seal substantially transverse to the longitudinal seal at a first package end; a second sleeve end seal substantially transverse to the longitudinal seal at a second package end, the area between the first and second seal defining a package interior and fold lines to define a front wall and a rear wall, the seals further forming front and rear package panels; and a pair of low tack pressure sensitive adhesive (LTPSA)

layers disposed on a same exterior panel surface generally aligned to each other and generally equi-distant to a fold line between the LTPSA layers.

Another embodiment provides a flexible film package having an adhesive based reclosable fastener, having a flexible film substrate forming a plurality of package walls sealed to form an interior cavity for receiving a product; the plurality of walls having at least first and second opposing flexible walls, wherein the second opposing flexible wall extends beyond the first opposing flexible wall; a first low tack pressure sensitive adhesive (LTPSA) layer disposed on an exterior surface of the first opposing flexible wall; a second LTPSA layer disposed on an interior surface of the second opposing flexible wall on a portion that extends beyond the first opposing flexible wall, the LTPSA layers configured to be adjacent to one another when the package is closed along a fold line; and a package mouth oriented between the first and second LTPSA layers, initially sealed, to permit access to the interior cavity.

Another embodiment provides a flexible film defining an interior contents cavity and having a first pair of opposing edge portions forming a first end seal, a second pair of opposing edge portions forming a second end seal, and a third pair of opposing edge portions forming a longitudinal seal extending from the first end seal to the second end seal; the flexible film having a first side portion and a second side portion generally opposite the first side portion; a package mouth, initially sealed by at least one of the end seals, to permit access to the interior cavity; a pair of low tack pressure sensitive adhesive (LTPSA) layers disposed on the same exterior panel surface generally alligned with each other, transverse to the longitudinal seal, and generally equi-distant to a fold line between the LTPSA layer; and wherein the bond strength of the LTPSA to the flexible film substrate is greater than the adhesion between LTPSA areas.

A method to form one of the present embodiments can provide the steps of applying a low tack pressure sensitive adhesive (LTPSA) to a flexible film, the pressure sensitive adhesive includes a UV-curable acrylic oligomer, a tack control agent, and optionally an elastomeric material; curing the applied LTPSA on the flexible film by application of ultraviolet radiation; supplying the cured flexible film to a form, fill and seal machine; and forming the flexible film into a flexible package having the LTPSA layer disposed on each of an exterior surface of package parallel walls oriented in positions to oppose one another at a plurality of positions when the package is reclosed to allow progressively decreased size of the interior cavity as product is removed.

Other features will become more apparent to persons having ordinary skill in the art to which the package pertains and from the following description and claims.

BRIEF DESCRIPTION OF THE DRAWINGS

The foregoing features, as well as other features, will become apparent with reference to the description and figures below, in which like numerals represent like elements, and in which.

DETAILED DESCRIPTION OF THE EMBODIMENTS

Figures 1, 2:
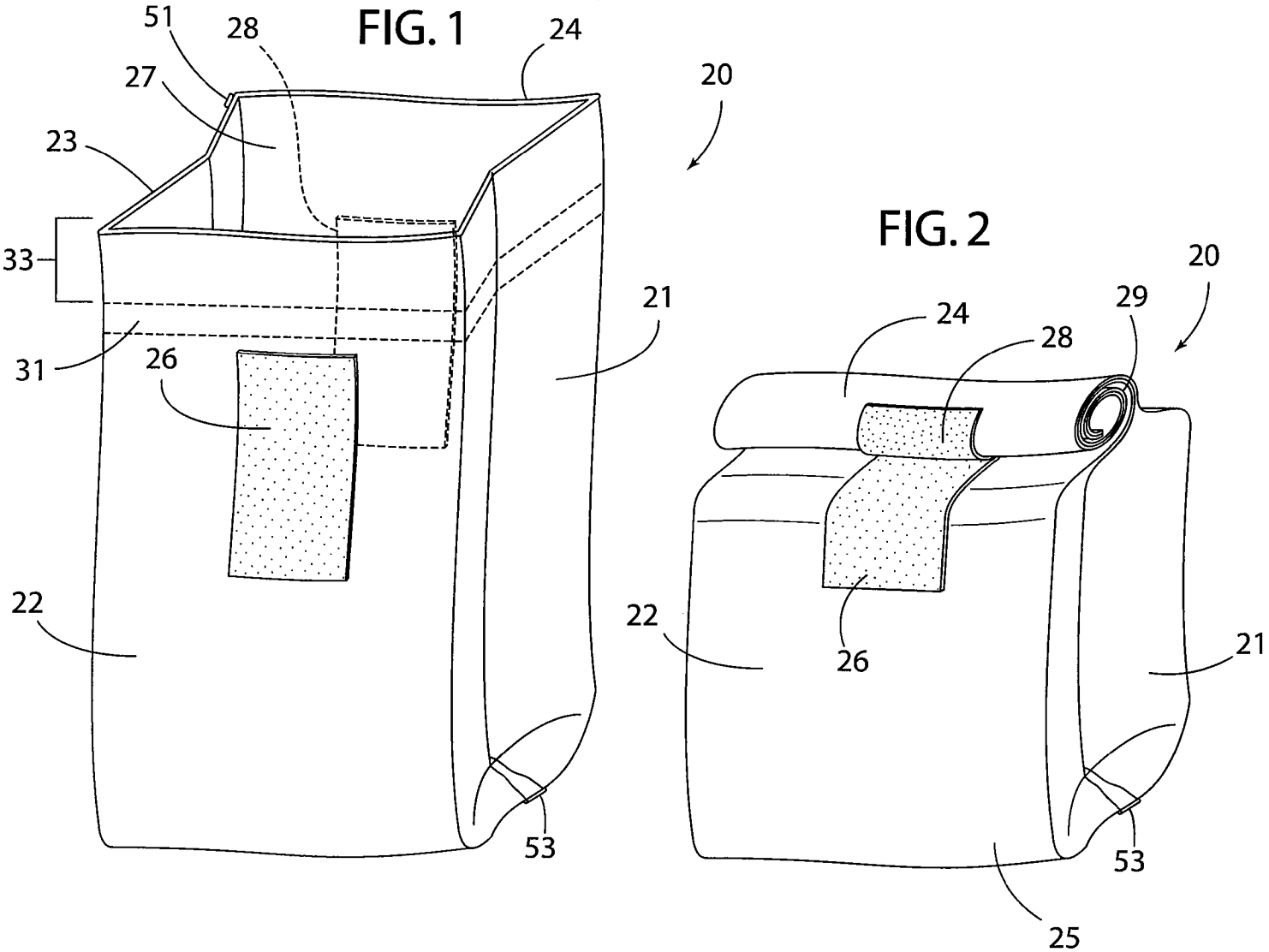
FIG. 1 illustrates a perspective front view of an embodiment of an exemplary reclosable flexible film package using a low tack adhesive in an open position.
FIG. 2 illustrates a perspective front view of an embodiment of an exemplary reclosable flexible film package using a low tack adhesive in a reclosed condition.

Provided herein are embodiments that relate to packaging products, and in particular to reclosable packaging products using low-tack adhesive zones (or areas) affixed to at least one exterior surface or panel of the package (and optionally one at least one interior surface) as a fastener that is self-adhering, but does not stick to unlike surfaces. In some embodiments, a package can have at least one seal that can act as a gas and moisture barrier for extended periods of time. The LTPSA zones can be oriented so that they are adjacent to each other to tack close the package when it is reclosed. The embodiments can be easily opened and reclosed/resealed, while maintaining package integrity. Features of the present embodiments can include product containment, increased product freshness, and in some embodiments a reduction in package size as product is removed to reduce headspace above the product. The present embodiments provide a low cost reclosure mechanism compared to a zipper or tin-tie closure systems since the low tack adhesive can be printed or coated on the film by a converter known in the art. Accordingly, costly packaging line upgrades or equipment retrofits are not required.

The present low-tack embodiments can provide several advantages. The embodiments described herein have an adhesive that is self-adhering, but does not stick to unlike surfaces or materials. Zones of LTPSA coating can be applied to a film by a converter. Once the film is wound into rolls, the LTPSA zones do not adhere where it contacts the opposite side of the film in the roll. Excessive opposite side adhesion (as would occur with high tack PSAs) would result in "blocking", an undesirable condition where film does not unwind freely from a roll, and could not run on a packaging line. Even if the blocking issue were solvable, a tacky pressure-sensitive adhesive would tend to stick to rollers and other equipment surfaces as it traveled through the packaging machine.

Further, assuming production issues could be solved with an exterior high tack PSA, an exposed high-tack pressure sensitive adhesive on the outside panels of a flexible package could be problematic on a store shelf, in a shopping cart, in a pantry, etc. because it would tend to adhere to any solid surface on which it contacts. It would also have an undesirable "sticky" feel to the touch. At a minimum, a solution could be to provide an additional layer of material to cover the high tack PSA until it was needed by the consumer for reclosure. However, this adds expense and waste to the overall package design and manufacture.

With regard to the illustrated embodiments an externally applied LTPSA zone does not need to contact the product as found in LTPSA applications that have the adhesive zones on the interior surface of the package side-panels (See generally, U.S. 61/317,592 to Kraft, which is incorporated herein by reference). For example, direct contact between an adhesive coating and certain types of products, especially those containing very fine particulates (e.g., under 150 microns in diameter, powdery topical seasonings, roast and ground coffee, shredded cheese, powdered beverages, and the like), moisture or certain oils, may not be desirable in some product applications.

The present embodiments are illustrated for food product applications, such as particulate products (e.g. coffee), breads, crackers, cookies, confectionaries, frozen vegetables, prepared salads, gum, chocolate bars, cereals, and the like. It is noted though that the embodiments can equally be applied to non-food products such as medical, pharmaceutical, industrial package applications, pet food, storage bags, personal care, lawn care products, fertilizer, pesticides, and the like.

The illustrated flexible flow-wrap embodiments described herein can be generally formed from a flexible film/web material (optionally scored). In some embodiments, the package shape can be a pouch having a front panel and a rear panel defined by fold lines or seals in the film. It is noted though that given the flexibility of the laminate film, package shape can be influenced by the product contents or internal trays. The packaging can be a slug or even dual-slug configuration. In short, any packaging that allows flexibility to create an opening for clean product access can use the present embodiments to provide a re-closable feature, which can maintain the package in a closed position, when desired. It is noted, though, that the LTPSA embodiments can equally be applied to rigid containers, such as a rigid paperboard applications. By way of example, a paperboard chewing gum package could employ the LTPSA features described herein.

Low Tack PSA

Several LTPSA formulations are possible for use with the present embodiments, such as those described in U.S. Ser. No. 13/035,399 to Kraft Foods, which is incorporated herein by reference. The LTPSA can be a UV curable low tack adhesive composition provided in a liquid form that can be pattern applied onto the packaging film and cured with UV energy to form a solid low-tack adhesive coating. The resultant coating is self-adhesive and is effective for multiple open-reclose cycles. The low tack property also allows the film to slide across metal surfaces on a packaging machine without binding or jamming. A significant advantage of this low tack adhesive reclose system over traditional zipper reclose systems, is that only film registration capability is required, which most vertical baggers either already have or for which can be easily retrofitted.

The first component of the adhesive is one or more UV-curable acrylate or acrylic oligomers. For instance, the UV-curable acrylic oligomer may be an acrylic or methacrylic acid ester having multiple reactive or functional groups (i.e., acrylic or methacrylic oligomers). In general, a functional group includes one UV reactive site. By one approach, UV reactive sites are most commonly carbon-carbon double bonds conjugated to another unsaturated site such as an ester carbonyl group. By one approach, the UV-curable acrylic oligomer is an acrylic or methacrylic acid ester of a multifunctional alcohol, which means the oligomer has more than one acrylated or methacrylated hydroxyl group on a hydrocarbon backbone of the oligomer. By one approach, the adhesive may include about 1% to about 90% by weight of the UV-curable acrylic oligomers and with functionalities of about 1.2 to about 6.0. In another approach, the UV-curable acrylic oligomers may have a functionality of about 2.0 to about 3.0. In other approaches, the adhesive may include about 20% to about 70% by weight (in some cases, about 33% to 60% by weight) of the acrylic oligomers.

In one form, the multifunctional UV-curable acrylic acid ester is an acrylic acid ester of a vegetable oil having a reactive functionality of 2.0 or greater. In another aspect, the UV curable acrylic oligomer can comprise an epoxidized soybean oil acrylate. In general, the amount of the UV-curable acrylic oligomers used, based on an adhesive component ratio (ACR) (to be discussed herein), can impact the properties of the final adhesive. For instance, where the amount of the UV-curable acrylic oligomer is too low, based on an ACR, the cure rate of the final adhesive is too slow. On the other hand, where the amount of the UV-curable acrylic oligomer is too high, based on an ACR, the final adhesive may be adequately cured, but can have inadequate self adhesion properties to seal and reseal.

The second component of the adhesive is a tack control agent. By one approach, the adhesive may include about 1% to about 65% by weight of the tack control agent. In another approach, the tack control agent can be present in amounts from about 20% to about 65%. The tack control agent can include a tackifying resin or a curable polymer/monomer combination that when cured can produce the desired levels of tack and self-adhering properties appropriate for the reclosable fastener 12. In one aspect, the tack control agent can comprise an aliphatic urethane acrylated oligomer. Many other types of tack control agents suitable for UV-curable PSA adhesives may also be used in the reclosable adhesive system.

An optional third component of the adhesive is at least one elastomeric or rubber component. By one approach, the elastomeric component may include at least one curable acrylated (i.e., acrylic modified) or methacrylated esters of a hydroxy-terminated elastomeric polymer (i.e., an elastomeric polyol). This elastomeric component can include acrylic-modified polybutadiene, a saturated polybutadiene and/or a flexible polyurethane. In one aspect, a methacrylated polybutadiene can be provided. The elastomeric material can be provided in amounts of about 0% to about 20% when used in the adhesive. In one aspect, the elastomeric material is provided in amounts of about 5% to about 15%. Satisfactory adhesives can be made with the desired low tack, resealable properties as described herein without the elastomer component; however, it is believed that the elastomeric component aids in achieving an optimal coating performance. The optimal adhesive performance can be defined by properties such as self-adhesion, tack, viscosity, and cure rate, just to name a few. The elastomeric component is useful for adjusting peel strength properties, substrate adhesion strength, increasing flexibility, viscosity control, and cure rate modulation.

To achieve the balanced peel, tack, and bond to the package substrate as described herein, it was determined that the amounts of the three adhesive components need to fall within a specific adhesive component ratio (i.e., ACR) of the acrylate oligomer relative to the elastomeric and tack components. An exemplary ACR for the adhesive can be:

$$\frac{\text{(wt \% of acrylate oligomer)}}{\text{(wt \% of elastomeric material + wt \% of tack control agent)}} = 0.5 \text{ to } 1.5.$$

In one approach, the ACR can be in the range of about 0.8 to about 1.5.

The range for the ACR of the three components in the formulation has been found to provide a unique adhesive formulation with a low tack property to non-like substances (i.e., machine components, crumbs, food pieces, and the like), yet can seal to itself with sufficient bond or peel strength to maintain a seal therebetween as well as resist contamination. The adhesive in this specific ACR also provides for a resealable function that does not significantly reduce or lose its seal-peel-reseal qualities upon being subjected to repeated open and close operations. An ACR value below about 0.5 is generally undesired because the adhesive would require significantly large amounts of UV energy to cure. If the ACR is above about 1.5, the adhesive would cure quickly, but it would also have low (or no) peel strength, unacceptable for the adhesive closure herein. In addition to the desired range of the ACR, a satisfactory adhesive formulation in some cases may also have certain other parameters such as mixture-stability of the components, a certain viscosity of the formulation, a certain cure rate, and/or a certain peel strength.

The adhesive LTPSA strips adhere together with sufficient force to hold a rolled-down upper portion of the package (or in some embodiments a fold down flap) in a closed position. The adhesive can have a peel force that is typically between 200 and 900 (and preferably 200-600) grams per linear inch. In any event, the peel force should be sufficient to maintain the rolled-up (or folded) portion of the flexible package in a closed position, while at the same time being re-openable by applying typical pressure applied if a consumer were to apply mild finger pressure to unroll (unfold) the package. Furthermore, the present adhesive system is effective to open and reclose the package at least 10 times without a significant drop in peel force and without delaminating from the package surface. The LTPSA can be suitable for tacking or reclosing in ambient and even refrigerated conditions. For example, the LTPSA can be functional between about 0 degrees Celsius to about 38 degrees Celsius.

Like many pouches used for food packaging, the packaging film can be a multi-layer laminated structure. The film for the present embodiments can be a flexible sheet material rolled or formed as a blank and made of laminate or co-extruded film structures, with cast or blown film layers, and the like. Examples can include a single layer polymer such as polypropylene, polyethylene, polylactic acid (PLA), polyester, oriented polyester, and the like. For the present embodiments, the outermost layer is preferably a reverse-printed, oriented polyester film (OPET). Film thickness can also be a function of the desired barrier to gas, moisture, and light; level of desired structural integrity, and the desired depth of any desired score line.

The film can also contain a heat sealable polymer layer. In some embodiments, the heat sealable polymer forms a seal between 50 and 300 degrees Celsius. The film can also be a pressure sealing film, such as a cold seal. In some embodiments this pressure sealing film can form a seal between a pressure of about 0.7 and 7.0 Kg/cm, and preferably at about 5.6 Kg/cm. The sealant layer would be oriented on the film surface directed to the interior of the package. The sealant layer can be a variety of polymer sealants such as a heat activated polymer sealant layer like ethylene vinyl acetate (EVA), ionomer plastic (such as one sold under the trade name SURLYN by DuPont), linear low density polyethylene (LLDPE) (including matallocene-LLDPE), and the like. Cold sealant and pressure sealants are also possible within the scope of the presented embodiments. It is noted that food grade sealants would be used when food products are anticipated.

The film can optionally be a laminate such as a polyethylene terephthalate (PET) layer and an oriented polypropylene (OPP) layer, or optionally be a single layer polymer. A PET layer is flexible to semi-rigid, depending on its thickness. PET, and especially oriented PET (OPET), is desirable in that it is very lightweight, strong, and can have high transparency when desired for package specifications. It can be also be useful as an oxygen (gas) and moisture barrier. The OPP layer can add further strength and be a further barrier to permeability. Lamination components can be joined by adhesives or by extrusions. An exemplary flexible film can overall be in the range of about 1 to 10 mils in thickness and preferably in the range of about 2 to 6 mils in thickness.

The film can optionally have additional laminate layers or components. Stiffeners can be added to film compositions, such as a polyamide polymer (e.g., nylon). The stiffeners can be added as a component of the extruded film or as a separate layer. Nylon can be added as a laminate layer held to the film structure by an adhesive, optionally with film attached on each side of the nylon (i.e., tie layer). For illustrative purposes, the nylon layer can be about 8 percent of the film thickness or 0.004 mm.

Optional film layers can also include ink layers (not shown). For example, one laminate can include ink and a primer disposed between a PET and OPP layer. Package integrity features (not shown) can also be included. Metalized layers and various combinations of laminates are also possible within the described embodiments. Specific film laminate embodiments can include a 48 ga OPET (or 0.3 to 1.0 mils), a print layer, an LDPE layer and a 1.75 mil EVOH-LLD sealant film; or one having a 48 ga OPET, a print layer, and adhesive layer, a 60 ga nylon layer, and adhesive layer, and a 2.75 mil LLDPE sealant film.

The present film is configured to retain the LTPSA (i.e., not delaminate), even after repeating opening and closing of the package. Bands or strips of a LTPSA can applied in the form of a surface-coating (e.g., coated directly on the packaging film by an efficient, high-speed printing process or slot-die coating process at the converter) on the outside surfaces of 2 opposing flexible film panels. It is noted that the LTPSA zones can also be applied using a double faced tape, which may or may not use a carrier, to the surface of the film (web). In either case, the low tack adhesive strips are oriented so that when an open portion of the flexible package is rolled or folded down upon itself, as illustrated herein, after package contents are removed, the adhesive strips can come into contact with one another. The low tack adhesive can preferably be about 0.1 to 5.0 mils in thickness, though preferably about 0.8 mils thick. As stated below, use of a sealant containing an organoclay filler achieves a strong primary bond between the low tack adhesive and the substrate.

For the present embodiments to perform as desired, a strong bond between the low tack adhesive coating and the outer layer, such as OPET (and optionally an inner sealant layer) is important. If the bond is poor, the adhesive will delaminate from the substrate and the package will not reseal. Various approaches may be used either alone or in combination to promote a strong primary bond between the low-tack adhesive coating and the packaging film substrate such as OPET or an EVA/LLDPE blend. For example, a chemical primer can be applied to the substrate prior to coating with the adhesive. Surface treatments such as corona discharge, plasma and flame treatment may also be effective to promote a strong primary between the adhesive and substrate. Finally, certain fillers such as calcium carbonate, dolomite, talc (a mineral composed of hydrated magnesium silicate), mica, phyllosilicates, organically modified montmorillonite, and various combinations thereof when dispersed within a polymer based film, can be very effective to promote a strong primary bond. Accordingly, an exemplary formulation for an inner sealant that could be a suitable substrate for LTPSA can include an EVA, LLDPE blend with organoclay.

Several package configurations utilizing low tack adhesive are possible, including: vertical or horizontal form-fill-seal pouch (VFFS or HFFS) with a strip of low tack adhesive on opposing panels, such as panels running parallel to and adjacent to a peelable heat seal; low tack adhesive used in place of cold seal for a flow wrap package; a pouch with the low tack adhesive arranged, or in the form of bands (for example, parallel bands) spaced at intervals down the external or internal surface of a pouch, optionally having defined areas of weakness (e.g., score lines, perforations, and the like) enabling the pouch to be sealed lower and lower as the product level falls, and allowing the excess film to be removed and discarded by tearing along the score-line; and a rigid paperboard carton with a reclosable flap that is reversibly secured in the closed position by a pattern of low tack adhesive.

Generally, the illustrated packaging can be formed to have a fin or lap-seal and two end-seals, which can have hermetic (or substantially hermetic) seals formed by processes of heat seal, cold seal, low tack adhesive seal, and combinations thereof. The package can optionally include an internal rigid support such as a product tray, or "U" board, though this is not required to practice the embodiments. The package can be suited for vertical bagging with un-stacked or particulate products. The embodiments can provide not only a light barrier, but also a gas and moisture barrier.

The package can use a variety of means to open the package, such as peel tabs (not shown), peelable seals, areas of weakness, or openings scored in the film. In use, as a peelable seal is pulled, the sealed film layers separate creating an opening/mouth for product access. In some embodiments, the package generally provides a die or laser cut/score of various patterns.

Figure 9:
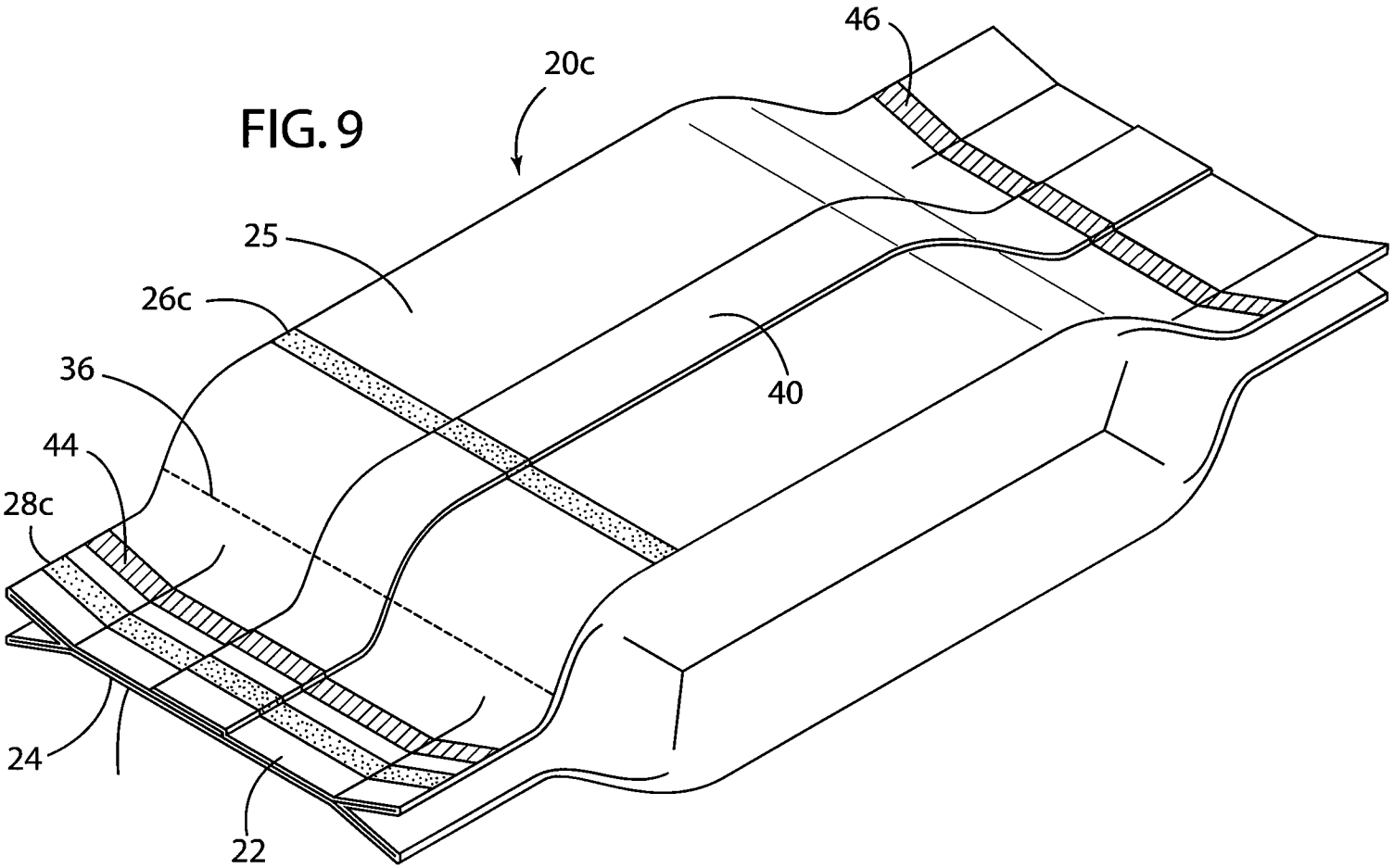
FIG. 9 illustrates a perspective front view of a third alternate embodiment of an exemplary reclosable flexible film package using a low tack adhesive.
Figure 17:
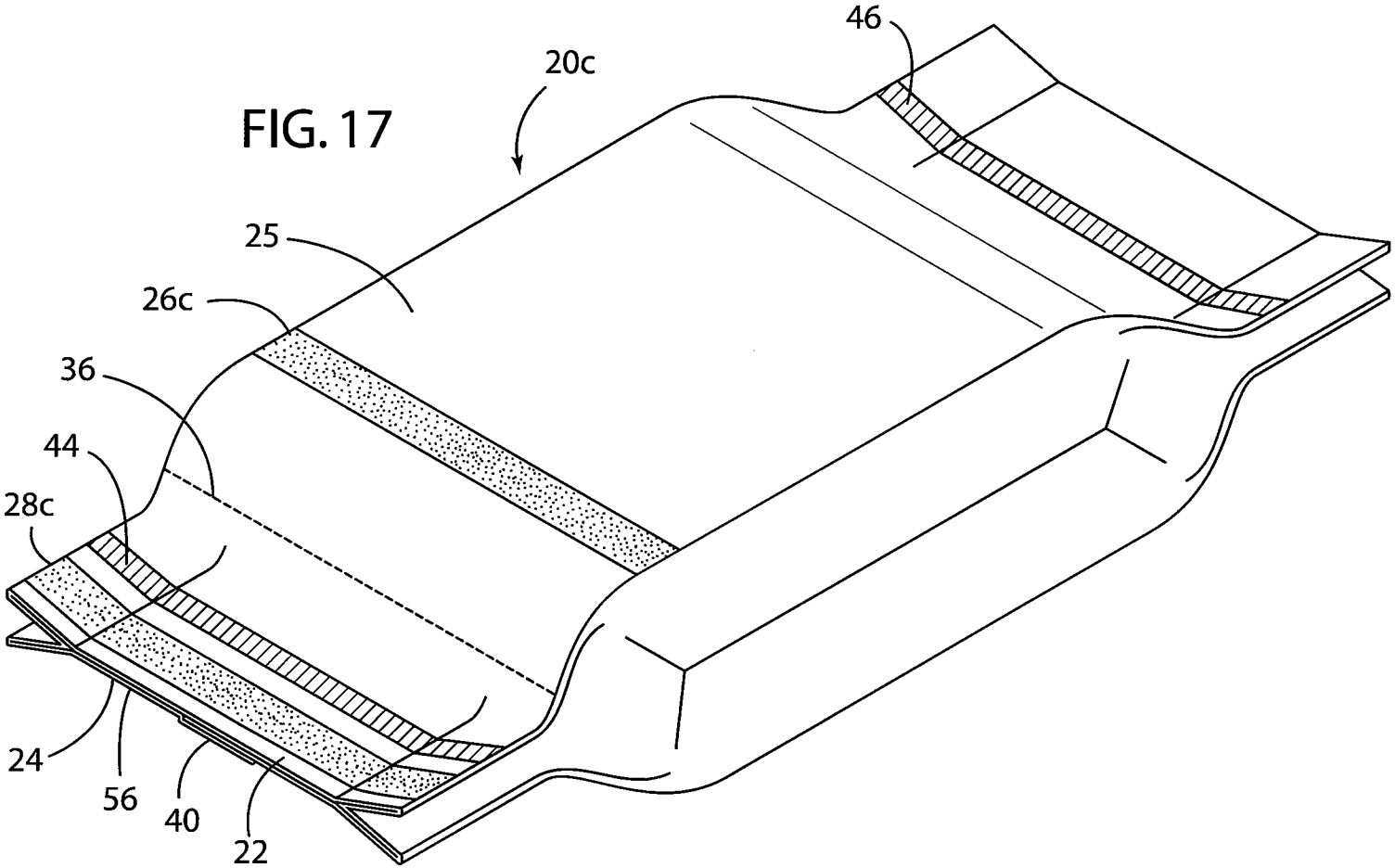
FIG. 17 illustrates a perspective front view of a fifth alternate embodiment of an exemplary reclosable flexible film package using a low tack adhesive.

Turning now to the Figures, there are shown embodiments of a present package design generally indicated at 20, and wherein similar elements are similarly numbered for each embodiment. In a basic embodiment illustrated in FIGS. 1-4, package 20 can be a VFFS pouch made from a flexible film/web 25 sealed to form a bag having side panels 21 and 23, front panel 22 and rear panel 24. A mouth 27 is shown to allow access to the interior of package 20. Prior to accessing the contents of package 20, the bag would preferably have an upper seal (e.g., shown at 31 in FIG. 1; and, at 44 in FIGS. 9 and 17) to seal and contain the products during shipping, and a flange area 33 above upper seal 31 to facilitate grasping. Flange area 33 could accordingly be up to 10 cm in depth, but preferably in the range between about 1 and 3 cm. In any event flange area 33 would be of a sufficient depth to allow a user to grasp and separate the sealed panels. Package 20 can be sealed at the bottom by an end seal 53 in FIG. 1 and at 46 in FIGS. 9 and 17. A longitudinal seal 51 (40 in FIG. 9 and FIG. 17) can provide a final seal. Longitudinal seal can be a fin seal or a lap seal (as shown). It is noted that in FIG. 1, longitudinal seal 51 is oriented towards a corner of the package, while in FIGS. 9 and 17, longitudinal seal 40 extends along one of the panel surfaces. The distinction between FIGS. 9 and 17 is that in FIG. 9, the low tack pressure sensitive adhesive (LTPSA) zones are oriented to the panel with longitudinal seal 40; while in FIG. 17, the LTPSA zones are oriented to the panel opposite the panel with longitudinal seal 40. Both corner and panel longitudinal seal configurations are possible within the scope of any of the embodiments. It is further noted that the LTPSA zones as described for the embodiments herein are not oriented to be adjacent to or touching one another in its initially sealed configuration.

The reclose feature of package 20 is shown by two low tack pressure sensitive adhesive (LTPSA) zones (26, 28) oriented on opposing exterior panel surfaces 22 and 24. As described above the LTPSA can be 'printed' or pattern coated onto the panel surface. The LTPSA laminated layer can be disposed on each of an exterior surface of the parallel walls, the LTPSA sized and oriented in position to oppose one another at a plurality of positions when the package is reclosed to allow progressively decreased size (head-space) of the interior cavity as product is removed. LTPSA zones would typically be below upper seal area 31.

The package can be reclosed by folding or rolling the film to bring the LTPSA zones adjacent to one another. For example, as shown in FIG. 2, film 25 around mouth 27 can be closed by rolling the film downward along a vertical axis in either direction on a panel having the LTPSA. As shown, as the film is rolled, LTPSA layers oppose one another and as configured, adhere to one another. It is noted that although the LTPSA is shown as rectangles oriented toward the top of the package, many shapes LTPSA coverage are possible within the scope of the present embodiments, up to and including total LTPSA coverage of the external surface of the film. In some embodiments, the LTPSA can run the length of the panels.

Figure 3:
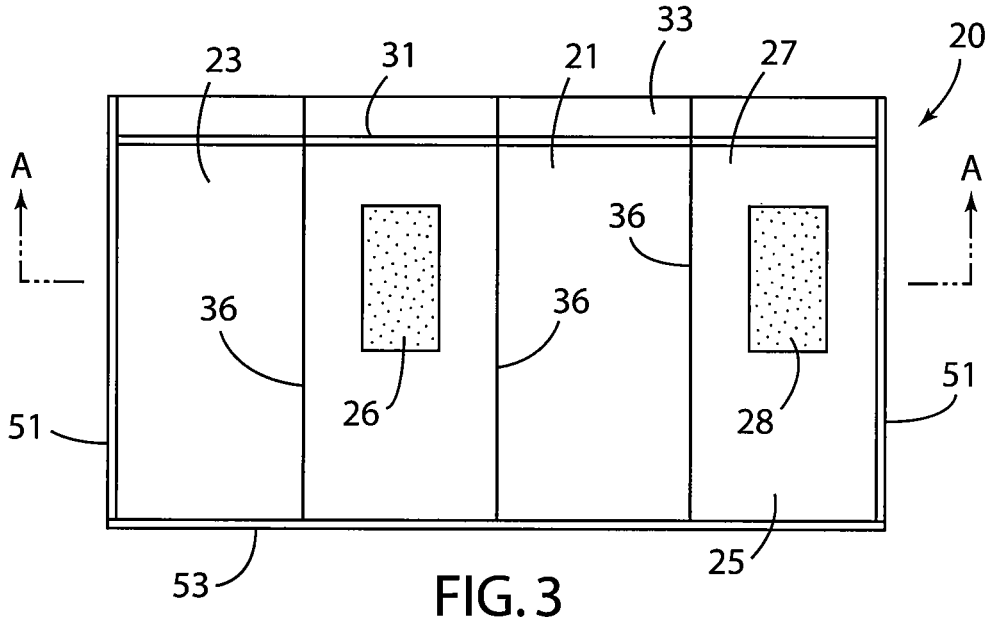
FIG. 3 illustrates a plan view of a film blank with a low tack adhesive showing fold and seal lines.
Figure 4:
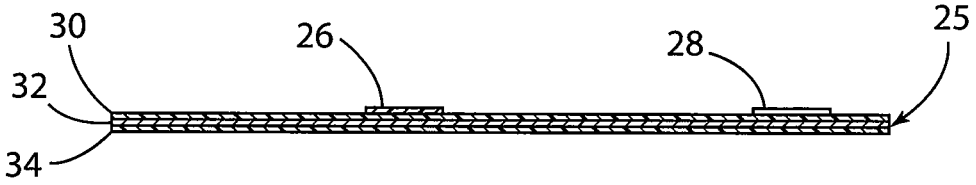
FIG. 4 illustrates a sectional view a film blank with a low tack adhesive taken along section lines A-A in FIG. 3.
Figure 13:
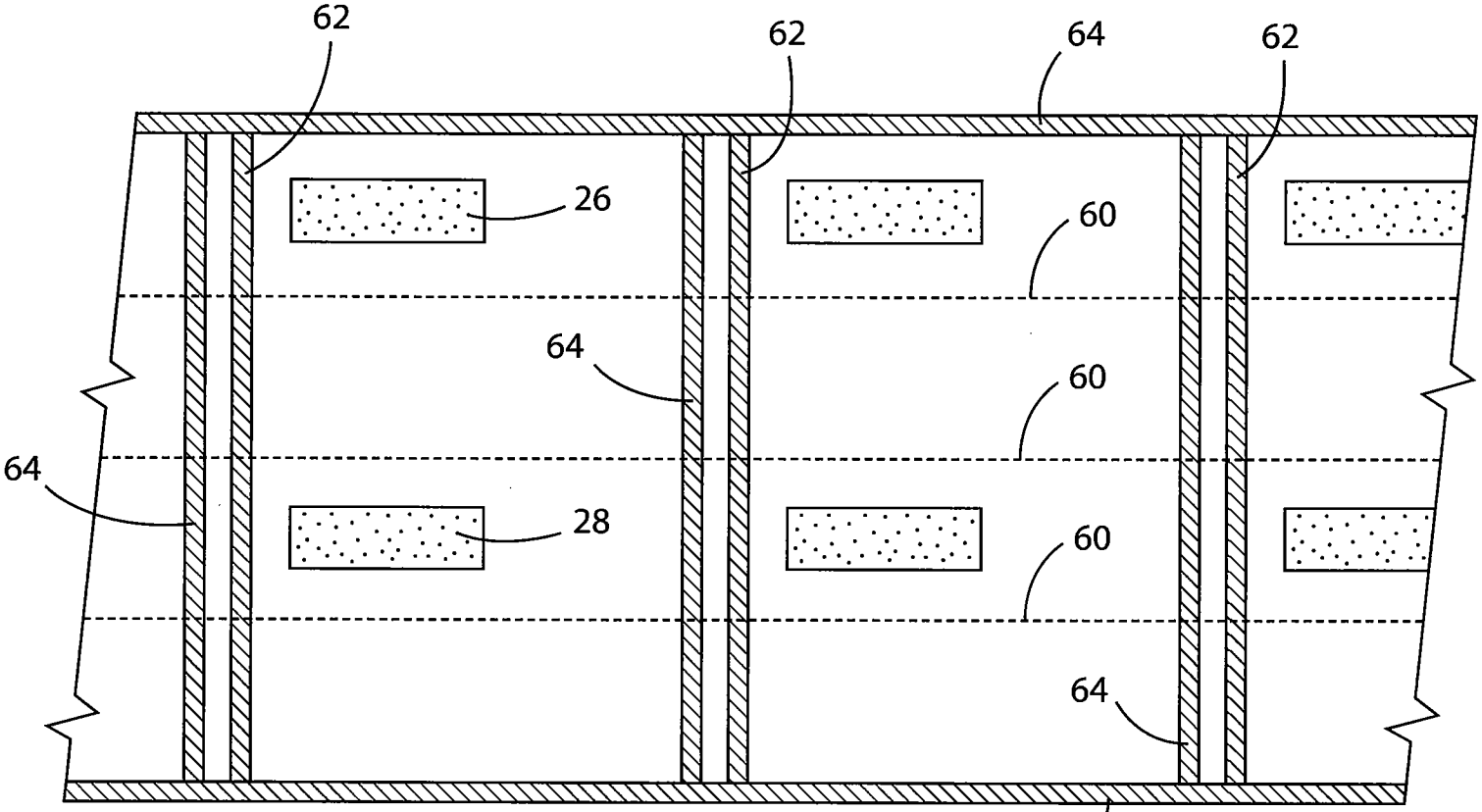
FIG. 13 illustrates a plan view of a section of a film roll blank of the embodiment of FIG. 1.

FIGS. 3 and 4 show a blank and FIG. 13 shows a section of a roll of blanks of the illustrated package of FIGS. 1-2. As shown, LTPSA are laminated and/or applied onto the same side of film 25, therefore, film 25 can be rolled onto large rolls prior to package forming without concern to the LTPSA surfaces contacting one another. In the blanks, upper seal area 31 of the film blank can indicate areas to form package seals, such as peelable seals, and fold lines 36 indicate where film 25 would be folded to form package 20.

FIG. 4 shows a cross section of one potential film 25 laminate of FIG. 3, using materials such as those described above. As shown in FIG. 4, film 25 can be formed of several flexible materials. As illustrated, film 25 can have an external layer 30, an intermediate layer 32, and an interior layer 34. Interior layer 34 can be a coextruded film with a heat sealable functionality and composed of, for example, EVA, polyethylene, polybutylene, ionomers such as surlyn or blends thereof. Intermediate layer 32 can be any of a variety of materials such as a metallic foil material or composite, such as aluminum. External layer 30 can be an OPET. The external 30 OPET layer may be modified to enhance the bond strength between the LTPSA and the substrate. Possible modification can included corona treatment (film passed under a plasma), flame treatment, adhesion promoting primer coatings, or inorganic fillers blended into the polymer layer. Filler can include calcium carbonate and organoclay blends. In any event, the film 25 laminate can be any of a variety of combinations to provide the desired barrier qualities of the product to its environment, while sealed.

Alternate embodiments showing LTPSA applied to exterior surfaces of packages to oppose one another in a closed position are illustrated in FIGS. 5-12.

Figure 5:
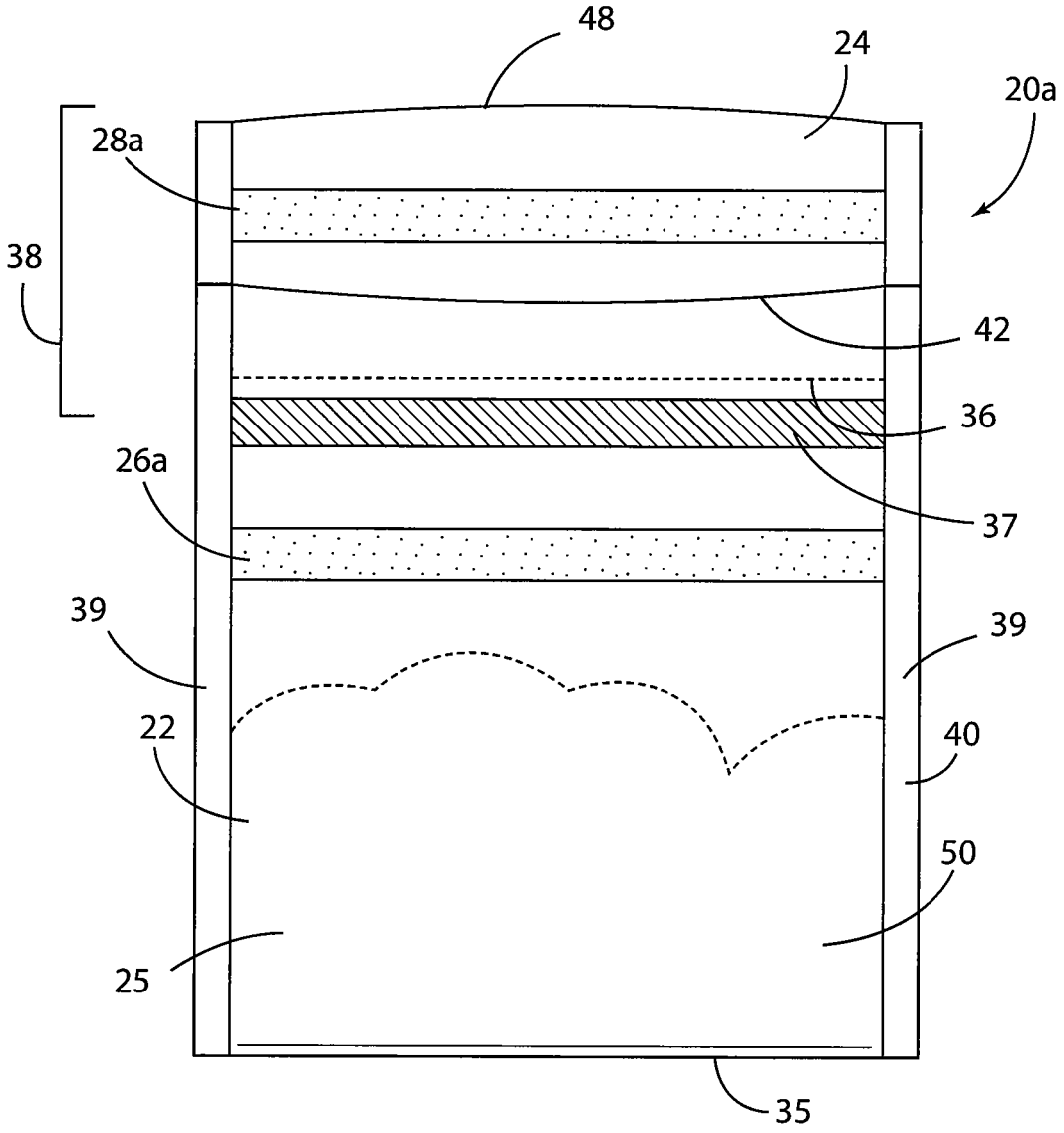
FIG. 5 illustrates a plan front view of a first alternate embodiment of an exemplary reclosable flexible film package using a low tack adhesive.
Figure 6:
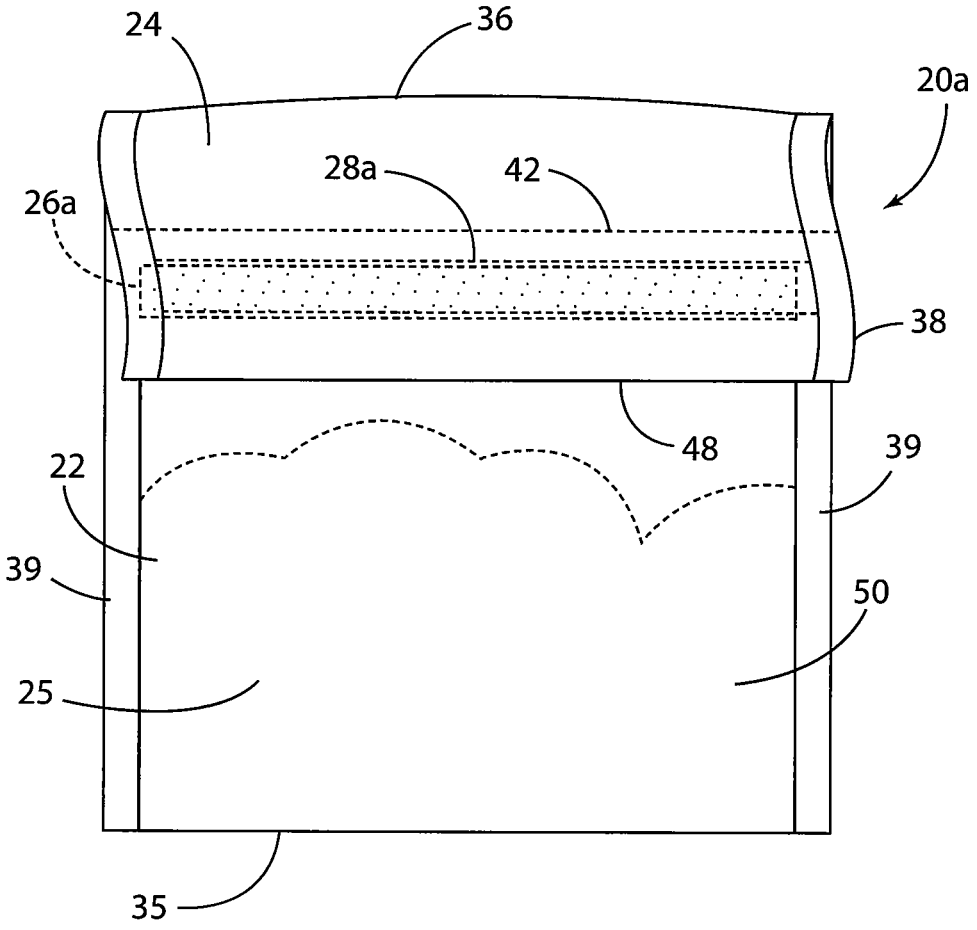
FIG. 6 illustrates a plan front view of a first alternate embodiment of an exemplary reclosable flexible film package using a low tack adhesive in a reclosed condition.

For example, in FIGS. 5-6 an embodiment 20*a* is shown as a type of HFFS two-panel pouch having both an internal and external LTPSA coated area. In this embodiment, a flexible film 25, or even a rigid paperboard panel, could be used. A seal 39, such as a heat seal described above can bind the sides of package 20*a*. Two LTPSA zones 26*a* and 28*a* are shown on the same front side of the package. As shown, the LTPSA zones are generally parallel to one another and generally equi-distant to a fold line 36. Access to a product 50 can be obtained through an opening 42. As shown in FIG. 6, a closure flap 38 can be formed as the top 48 of package 20*a* is folded down along fold line 36, LTPSA 26*a* and 28*a* oppose one another to close opening 42.

Figure 7:
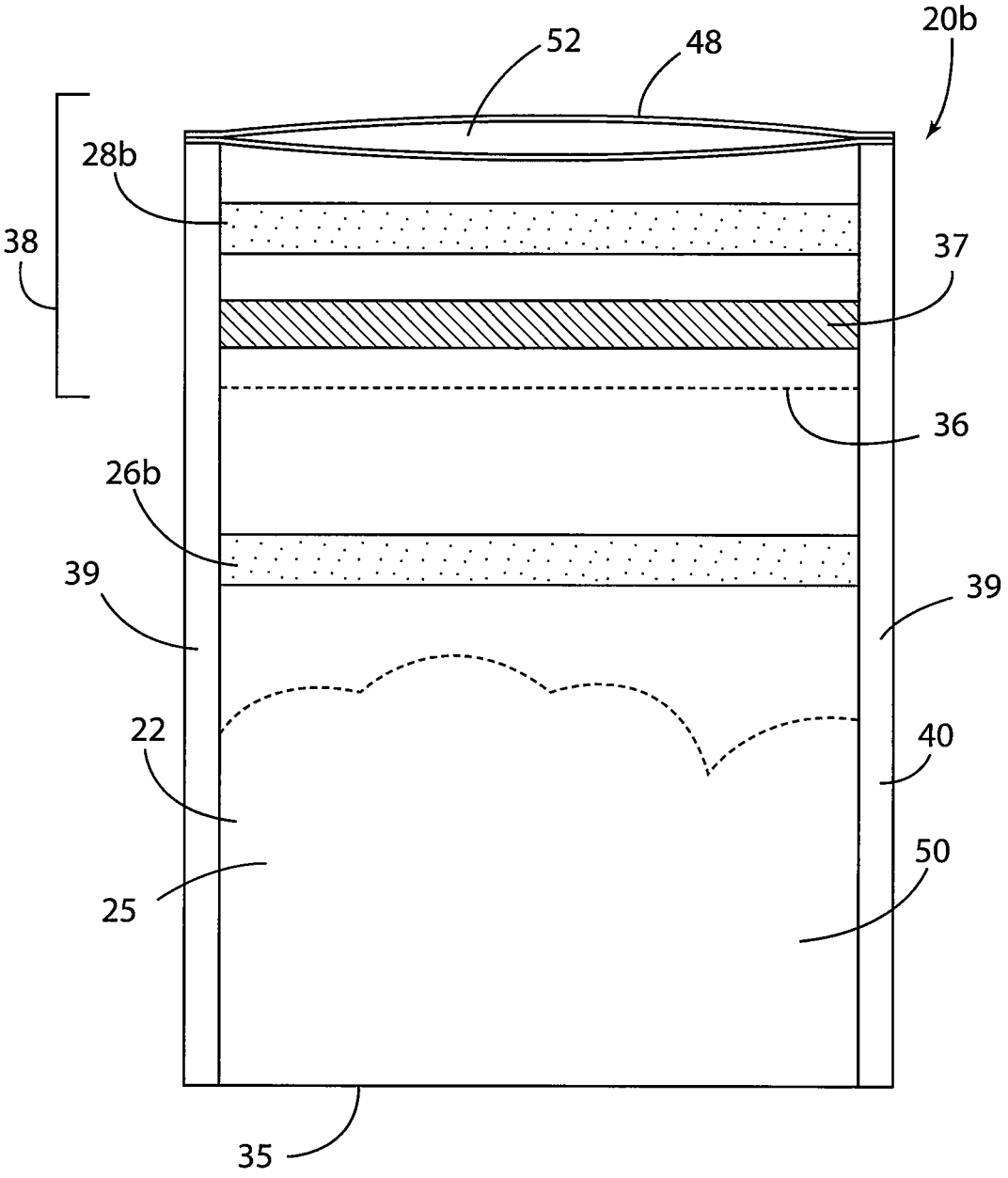
FIG. 7 illustrates a plan front view of a second alternate embodiment of an exemplary reclosable flexible film package using a low tack adhesive.
Figure 8:
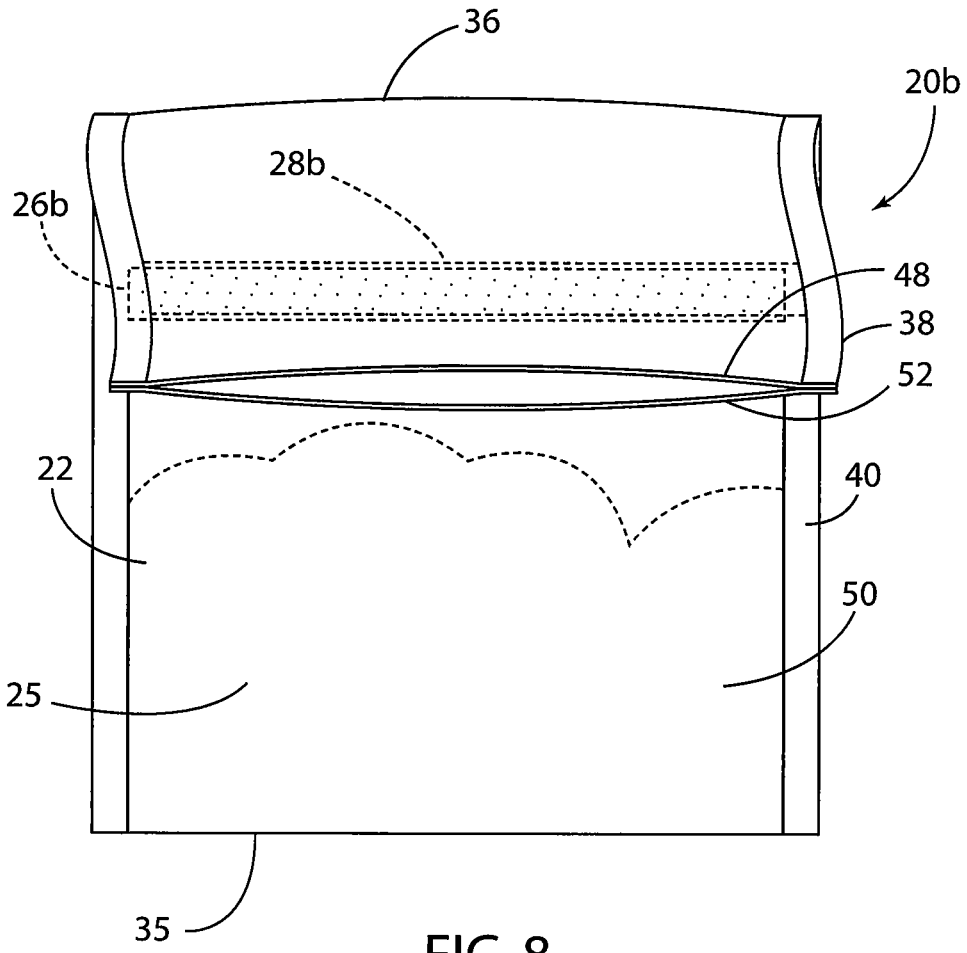
FIG. 8 illustrates a plan front view of a second alternate embodiment of an exemplary reclosable flexible film package using a low tack adhesive in a reclosed condition.

In another embodiment shown in FIGS. 7-8, package 20*b*, the LTPSA zones are similarly generally parallel to one another and generally equi-distant to a fold line 36, but the package is modified to have a top package opening 52. In other words, the opposing front/rear panels are generally equal in height. Access to a product 50 can be obtained through an opening 52, which can be located above and generally parallel to a peelable seal 37 in the film to allow an opening to form. It is noted that a peelable seal as described herein can be a heat seal or an adhesive based seal that is initially hermetic and is not configured for reclosability. As shown in FIG. 8, a closure flap 38 can be formed as the top 48 of package 20*b* is folded down along fold line 36, LTPSA 26*b* and 28*b* oppose one another to close opening 42.

Figure 10:
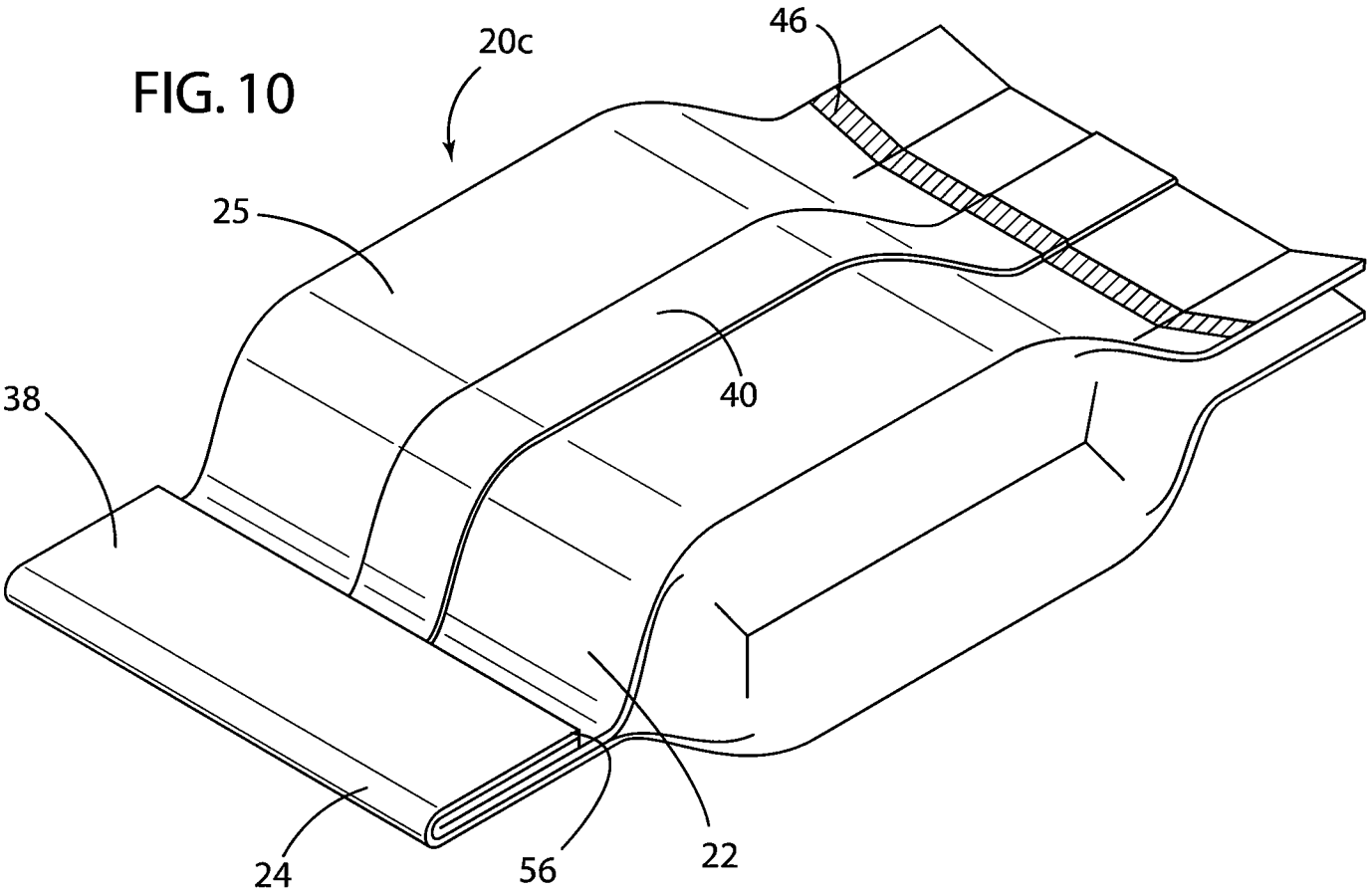
FIG. 10 illustrates a perspective front view of a third alternate embodiment of an exemplary reclosable flexible film package using a low tack adhesive in a reclosed condition.

Another embodiment shown in FIGS. 9-10, shows a flow wrap package 20*c* that can be formed in a horizontal form fill and seal method, as described below. Package 20*c* can be formed by joining opposite sides of film 25 to form a longitudinal seal 40 (shown in the Figures as a lap-seal, but could also be formed as a fin seal). As described above, film 25 would preferably have a sealant layer on an interior surface of the film. Peelable end-seals, such as a trailing end-seal 46 and leading end-seal 44 can also be provided to seal in the package's content. The initial package seals of the presented embodiments can be formed by heat seal, cold seal, and various combinations thereof to form the desired peelable and non-peelable seals.

As illustrated, a consumer could separate panels 22 and 24 at a leading end 56 by pulling peelable leading end-seal 44 open exposing the package interior. The LTPSA zones are similarly generally parallel to one another and generally equi-distant to a fold line 36. As shown in FIG. 10, a closure flap 38 can be formed as the top 56 of package 20*c* is folded down along fold line 36, LTPSA 26*c* and 28*c* oppose one another to close opening 42. It is again noted that the area of the LTPSA coating and self-adhesion strength is defined according to specific package and product requirements and can include up to the entire surface being covered by the LTPSA. It is also noted that seal 40 can be oriented to a corner of the package or to the panel that is not laminated with the LTPSA.

Figure 11:
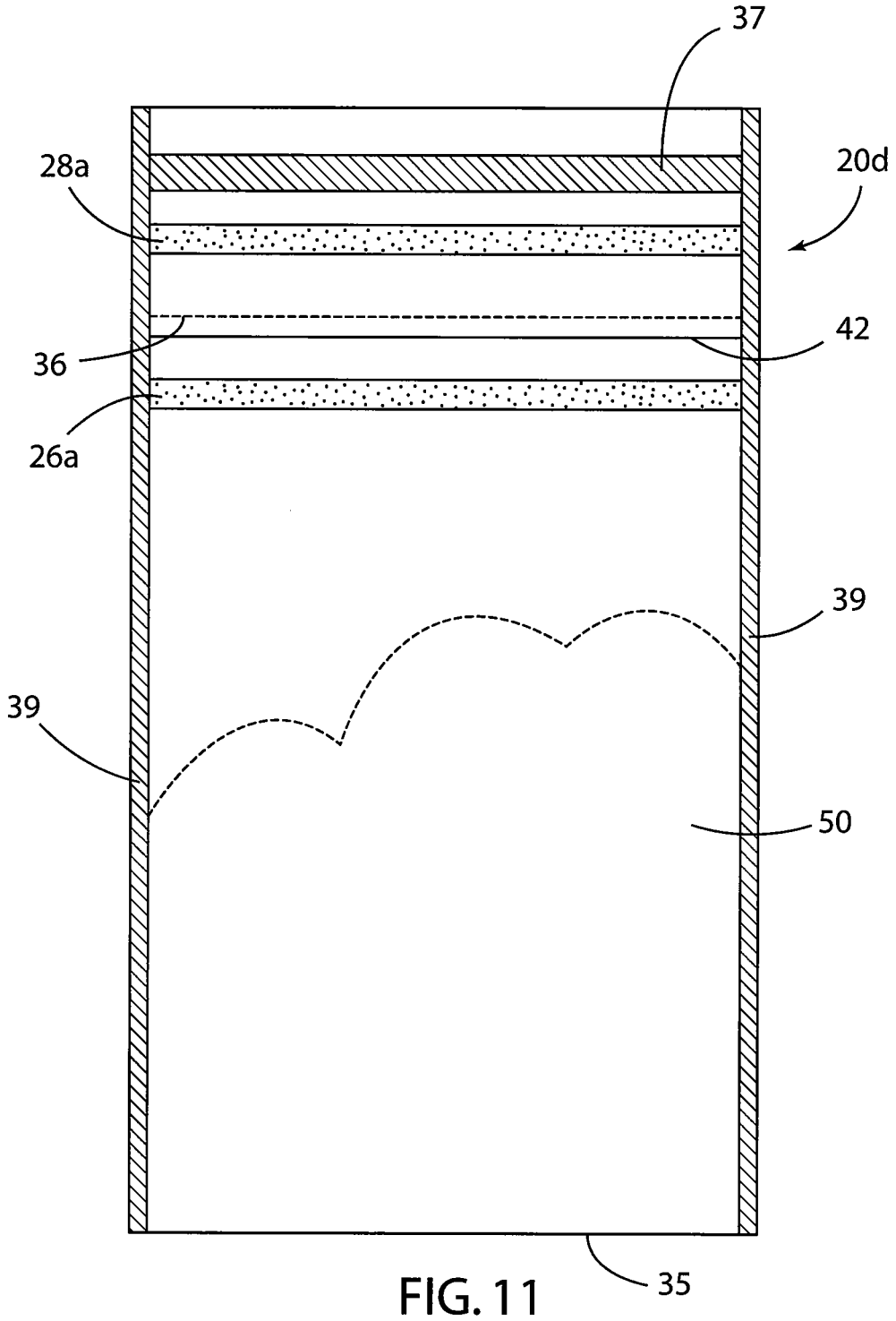
FIG. 11 illustrates a plan front view of a fourth alternate embodiment of an exemplary reclosable flexible film package using a low tack adhesive.
Figure 12:
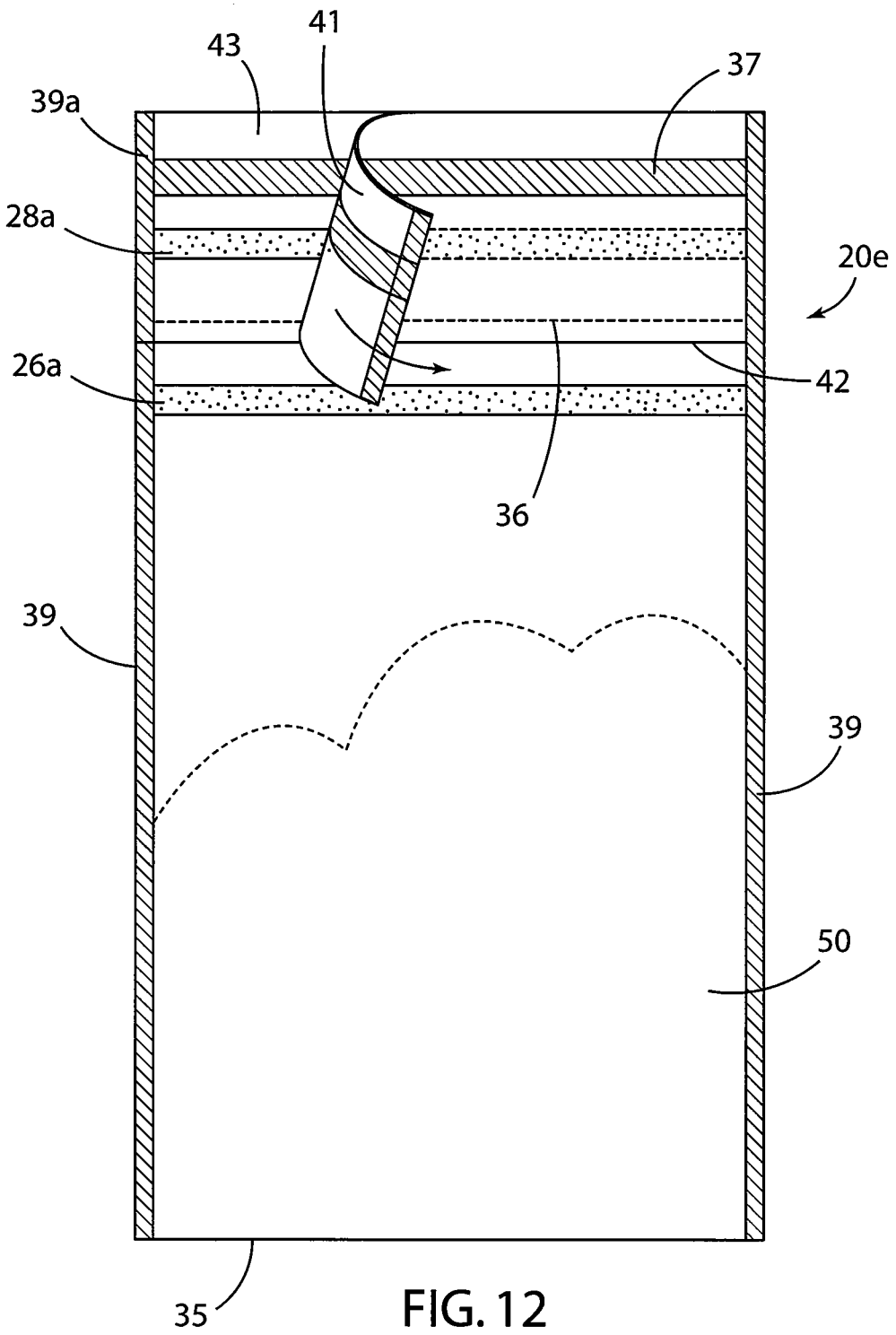
FIG. 12 illustrates a plan front view of a fourth alternate embodiment of an exemplary reclosable flexible film package using a low tack adhesive in an opened position.

FIGS. 11-12 illustrate alternate package embodiments generally indicated at 20*d* and 20*e* respectively. In the embodiment of FIG. 11, an opening 42 is formed by a defined area of weakness (such as a score line, perforation, notched oriented film, and the like) scored onto the front panel to define an opening. Score line 42 is only through a partial depth across the thickness of the film and can be configured to maintain a package seal. Once opened, the package can be reclosed by folding the top portion of the package forward along fold line 36 so that the LTPLSA regions 28*a* and 26*a* meet to form a package closure. In this instance seal 37 would not need to be a peelable seal.

A variation of the opening can be obtained, as shown in FIG. 12, by providing peelable seals at least at 39*a* above the score line 42 and on the top seal 37. For most embodiments, all package seals (i.e, seals 39 and 37) can be peelable seals. One area of LTPSA can be as shown at 26*a*, such as shown in FIG. 11. In the embodiment of FIG. 12, the second LTPSA area is found on the rear panel on the surface exposed to the interior. In this instance, a user can grip the tops of the front and rear panels in the unsealed area 43 above peelable seal 37 and pull the front panel until the film tears at score line 42 to form a tab 41, which can be removed from the package and expose a LTPSA 28*a* disposed on the interior side of the rear panel of the film. As in FIG. 11, once opened, the package can be reclosed by folding the top portion of the package forward along fold line 36 so that the LTPLSA regions 28*a* and 26*a* meet to form a package closure.

Figure 14:
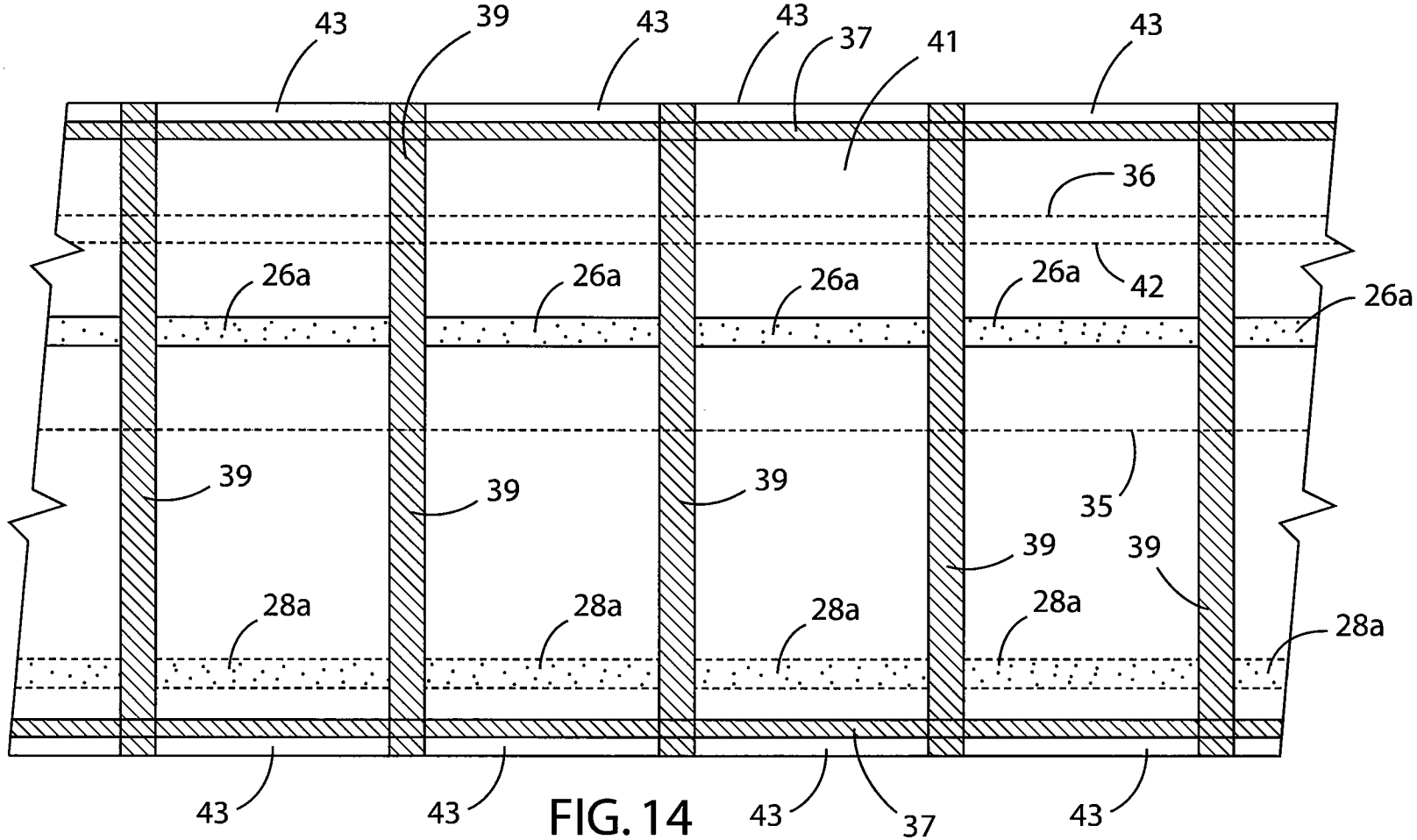
FIG. 14 illustrates a plan view of a section of a film roll blank of the embodiment of FIG. 11-12.

FIGS. 13 and 14 illustrate plan views of sections of a film roll blank of the embodiment of FIGS. 1-4, and FIGS. 11-12 respectively. In FIG. 13, the blank roll shows the patterning of LTPSA 26 and 28 and fold lines 60. The areas at 62 and 64 would define peelable seals. FIG. 14 provides a blank for a pouch, such as shown in FIGS. 11-12, showing an initial fold line 35 to define a dead fold to define the bottom edge of the pouch. As shown, LTPSA 26*a* and 28*a* areas are indexed between side seals 39. In other words, the areas of LTPSA are not exposed to the heat seal. Also, as shown in FIG. 14, the area of LTPSA is applied to both sides of the roll to allow formation of a package as described in FIGS. 11-12, and formed using a process found in FIG. 16. Although this type of indexed application of the LTPSA to the blank roll is preferred, it is noted that in some embodiments, the LTPSA can be continuously applied to the film, and thus the LTPSA is exposed to the heat seal. Alternately, the LTPSA can be of various dimensions and geometric configurations.

Figure 15:
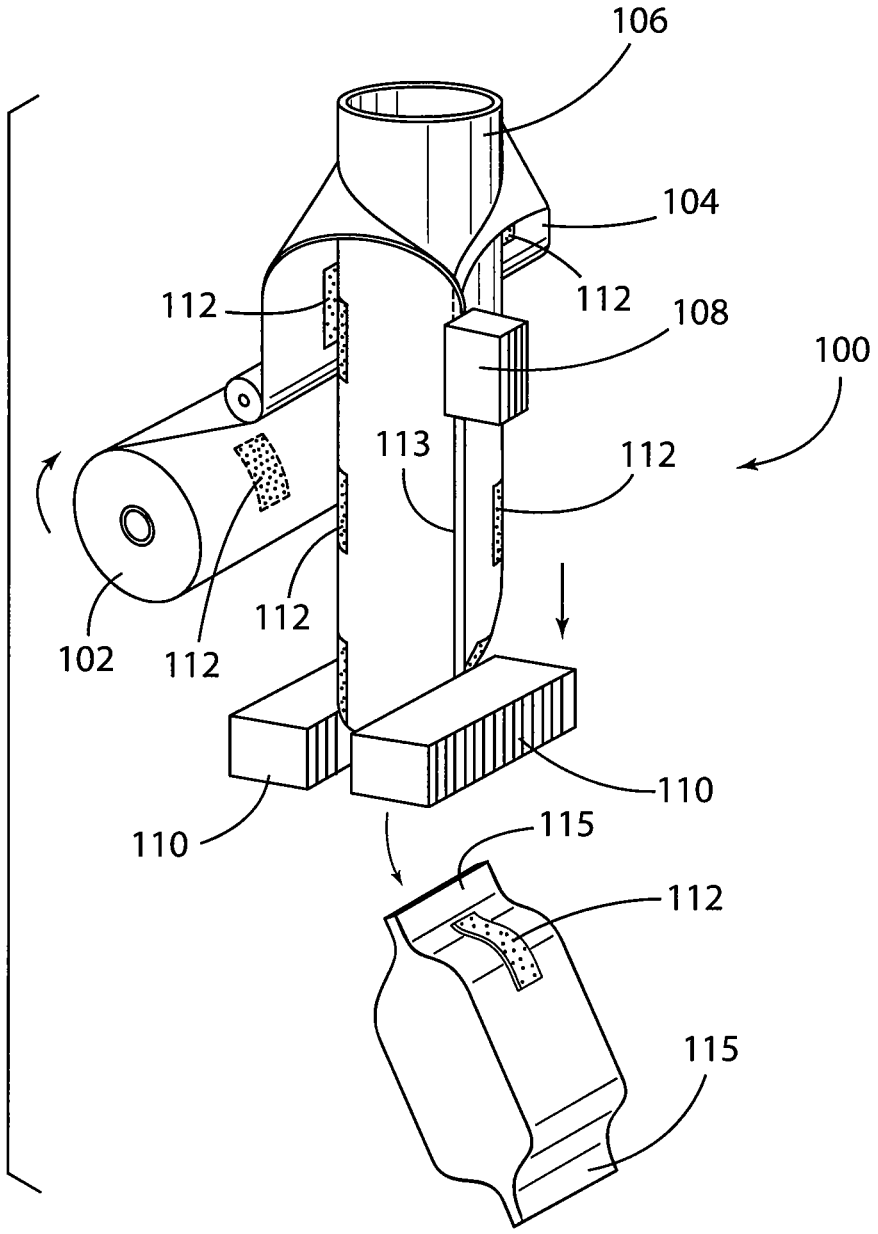
FIG. 15 comprises a partial perspective view illustrating an apparatus as configured in accordance with an embodiment of the invention.
Figure 16:
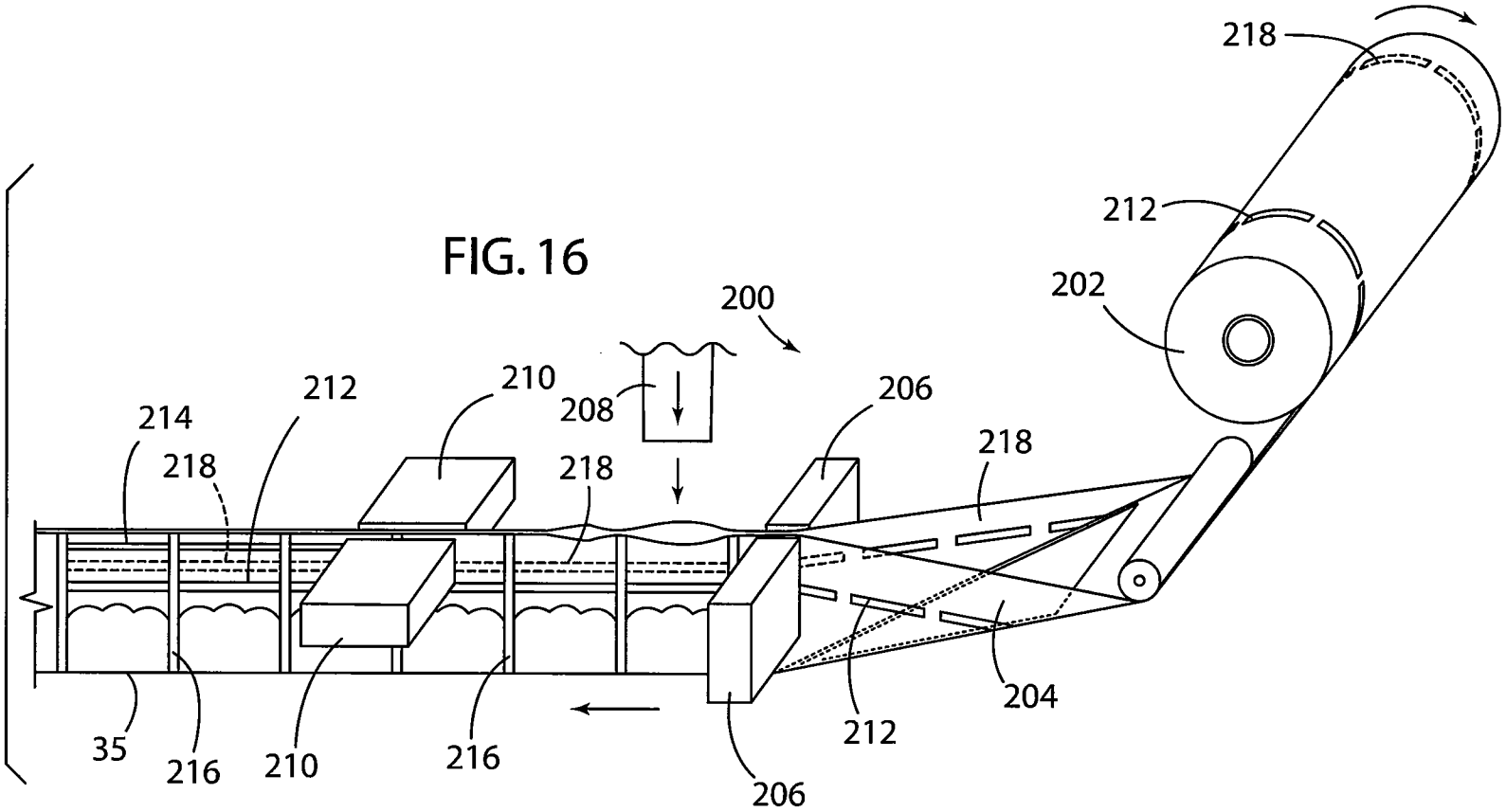
FIG. 16 comprises a partial perspective view illustrating an apparatus configured in accordance with an embodiment of the invention.

The method of manufacturing the flexible pouches may affect the particular seals, folds, and various other features of particular flexible pouches. A variety of manufacturing methods are available to commercially produce the flexible pouches and a few examples are discussed herein and illustrated in FIGS. 15 and 16. The flexible pouches may be made in a high-speed form-fill-seal (FFS) operation that can produce up to 800 packages per minute. FIGS. 15 and 16 diagrammatically illustrates approaches to forming a package 20. In one approach, bag 20 in FIG. 15 is prepared using a vertical form, fill and seal package machine commonly used in the snack food industry for forming, filling, and sealing bags of chips, cookies, coffee, and other like products and is generally shown at 100. FIG. 16, shows an alternate method using a horizontal form, fill and seal package machine and is generally shown at 200. Packaging machines 100 and 200 shown are simplified and do not show, support structures and control systems that typically surround a machine, but are provided to demonstrate one example of a working machine. The method of manufacturing the flexible pouches may affect the particular seals, folds, and various other features of particular flexible pouches. A variety of manufacturing methods are available to commercially produce the flexible pouches and FIGS. 15-16 provide but two of those examples.

In one illustrative embodiment shown in FIG. 15, the flexible pouches are made in a vertical FFS or bagging line. A series of flexible pouches is formed from a roll of film 102 having pre-applied areas 112 of low-tack pressure sensitive adhesive (LTPSA) applied, such that the front, back and side panels of the film material define a cavity. By one approach, a web of the rolled film material is fed over a folding shoulder 104 such as a forming collar and mandrel to provide it with a tubular shape. Opposite longitudinal edges of the film are brought together around the fill tube 106. The longitudinal edges are sealed, such as by a seal tool 108 to form a fin seal, or overlapped to form a lap seal. In this configuration, the fin seal 113 is used to form a corner of the package. A top/bottom seal 115 for the pouch can also formed by a reciprocating sealing tool 110, which may include a pair of reciprocating sealing bars. The reciprocating sealing bars can be heat sealing bars maintained at a desired temperature to apply heat and pressure to the front and rear walls. Further, the heat seal bars are brought together on opposite sides of the tubular web so that heat is conductively transferred to the film from both sides while pressure is applied. The sealing bars may be used in an intermittent or continuous operation. In an intermittent operation, the film is stopped while the sealing bars engage the film. In a continuous operation, the sealing bars may move vertically at the machine speed as they engage the film. In addition, sealing tool 110 may contain a reciprocating knife which acts to separate the bottom pouch from the upper pouch. Once the operation is complete and the upper pouch has been filled with food product, the upper pouch advances downward and becomes the bottom pouch. In addition to sealing the pouches, the sealing tool 110 may also be used to impart desired package folds.

Thus, the sealing tool 110 may perform a variety of functions simultaneously, including: creating the bottom seal of the pouch that is about to be filled with product; and creating a peelable heat top seal; and having a reciprocating knife or cutting tool which separates the pouch that was just filled from the following one which is about to be filled. Accordingly, after a bottom seal (and optional fold) is formed in the flexible pouch, the partially formed flexible pouch can then be filled with food product, which is introduced into the pouch via the fill tube 106.

There are a variety of alternative steps to those described in this vertical FFS operation. Also, alternate techniques may be employed instead of application of heat and pressure by heat seal bars as described above. For example, RF energy, ultrasonic energy or other techniques may be employed.

In another example, shown in FIG. 16, flexible pouches (such as shown in FIGS. 5 and 6, 11-12 and 14) can be manufactured in a horizontal FFS or a flow-form wrapper and is generally indicated at 200. Like the vertical process described above, a series of flexible pouches is formed and the film material defines a cavity. Here, the pouch has front and back panels. As illustrated, a single roll of film 202 having pre-applied areas of LTPSA on opposite sides of the film can be folded at a folding apparatus 204 and then sealed with a sealing die 206 to form side a seal 216 (e.g., peelable), and thus pouch cavities in series with one another. After the film is formed into cavities, the cavities can be filled with food product through fill tube 208. The pouches are then advanced in the machine direction. As shown in FIG. 16, the seal bars 210 can provide a peelable top seal 214 of the front and back panels of the pouch. It is noted that for this embodiment the peelable top seal 214 is configured to be above the areas of LTPSA 212 and 218. In a subsequent step (not shown) a cut can be made (e.g., by mechanical or laser score tool or the like) down the center of side seal 216 to separate the pouches. LTPSA 218 seal in this configuration is exposed to the interior surface of the package.

It will be understood that various changes in the details, materials, and arrangements of the package and process of formation thereof, which have been herein described and illustrated in order to explain the nature of the described package, may be made by those skilled in the art within the principle and scope of the embodied method as expressed in the claims.

We claim:

1. A flexible film package having an adhesive based reclosable fastener, comprising:

a flexible film substrate forming a plurality of package walls sealed to form an interior cavity for receiving a product;

the plurality of walls having at least two opposing flexible walls;

a package mouth to permit access to the interior cavity, wherein the package mouth is initially sealed;

a low tack pressure sensitive adhesive (LTPSA) layer consisting of a partial portion of a length transverse to the package mouth of each of an exterior surface of the at least two opposing flexible walls, the LTPSA layers sized and oriented at least in part in opposite positions to one another when the package is open and at a plurality of positions when the package is reclosed to allow progressively decreased size of the interior cavity as product is removed; and wherein a bond strength of the LTPSA layers to the flexible film substrate is greater than an adhesion between LTPSA layers.

2. The package of claim 1, wherein the mouth is formed by a peelable seal.

3. The package of claim 1, wherein the mouth is formed by a defined area of weakness.

4. The package of claim 1 wherein the LTPSA layers comprise a UV-curable acrylic oligomer, a tack control component and the flexible film substrate comprises an organoclay.

5. The package of claim 1, wherein the LTPSA layers further comprise at least one elastomeric material.

6. The package of claim 1, wherein the LTPSA layers are in the range of about 0.1 to about 5 mils in thickness.

7. The package of claim 1, wherein the LTPSA layers are in the range of about 0.8 to about 5 mils in thickness.

8. The package of claim 1, wherein the peel force of the LTPSA layers is about 200 to 900 grams per inch.

9. The package of claim 1, wherein the film is a laminate in the range of about 1 to 10 mils thick, and wherein a laminate layer bound to the LTPSA layers is a reverse-printed, oriented polyester film (OPET) in the range of about 0.3 to 1 mils thick.

10. The package of claim 9, wherein the film has a filler selected from the group consisting of calcium carbonate, dolomite, talc, mica, phyllosilicates, organically modified montmorillonite, and various combinations thereof.

11. The flexible film package of claim 1, wherein the LTPSA layers are elongated transverse to the package mouth.

12. The flexible film package of claim 1, wherein the LTPSA layers are proportioned to have a first dimension that is greater in a transverse direction of the package mouth relative to a second dimension in a parallel direction of the package mouth.

13. The flexible film package of claim 1, wherein the LTPSA is configured to be printed or pattern coated on each of an exterior surface of the at least two opposing flexible walls.

14. The flexible film package of claim 1, wherein the LTPSA on each of an exterior surface of the at least two opposing flexible walls are symmetrically oriented along an axis transverse to the package mouth.

15. The flexible film package of claim 1, wherein the LTPSA is self-adhering and non-adhering to unlike surfaces.

* * * * *